US005238196A

United States Patent [19]

Chang

[11] Patent Number: 5,238,196

[45] Date of Patent: Aug. 24, 1993

[54] UPRIGHT LEVER PRESSURE TYPE MILL

[76] Inventor: Jin-Hong Chang, No. 55, Chung Cheng Rd., Hsin-Ying City, Tainan County, Taiwan

[21] Appl. No.: 942,846

[22] Filed: Sep. 10, 1992

[51] Int. Cl.[5] ..... B02C 23/30

[52] U.S. Cl. ..... 241/56; 241/79.1; 241/129

[58] Field of Search ..... 241/56, 79.1, 80, 97, 241/109, 114, 119, 59, 110, 124–133

[56] References Cited

U.S. PATENT DOCUMENTS 3,955,766 5/1976 Chang ..... 241/56
4,682,738 7/1987 Chang ..... 241/56
5,067,662 11/1991 Chang ..... 241/56

*Primary Examiner*—Mark Rosenbaum

*Assistant Examiner*—Frances Chin

*Attorney, Agent, or Firm*—Bacon & Thomas

[57] ABSTRACT

The present invention relates to provide an upright lever pressure type mill, and particularly to a mill which may enable the internal mill wheel to hold tightly against the external mill wheel to a preset pressure based on the principle of leverage in order to increase milling efficiency, reduce noise and protect mill wheels against wearing. The mill includes a powder suction/-delivery device, a separation device, a milling device, a lever pressure device, a variable speed mechanism and a transmission device. The milling device includes an integrally molded external mill wheel, a centrifugal disc and a number of internal mill wheels. The spindle of the internal mill wheel has a pressure lever for mounting a tension spring and for giving necessary tensile force as required on the principle of leverage.

12 Claims, 10 Drawing Sheets

UPRIGHT LEVER PRESSURE TYPE MILL

FIELD OF THE INVENTION

The present invention relates to a mill and particularly to a upright lever pressure type mill which applies spring tension to pressure the internal mill wheel by means of the lever in order to protect the internal mill wheel against collision with the external mill wheel in order to increase milling efficiency.

BACKGROUND OF THE INVENTION

The continuing progress of living quality in recent years has resulted in increased industrial standards. The rise of environmental protection consciousness and the constitution of GMP Standards for food products and medicine manufacture, has resulted in an urgent demand for a mill to conform to various items of rigid GMP standards: a. ingredient; b. noise; c. percentage of metallic dust (chiefly sourced from the mill wheel wearing); d. temperature; and e. pollution. Nevertheless, none of the domestic manufacturers are able to produce a mill to pass the rigid GMP inspection.

A satisfactorily designed mill must consider five major factors: a. torsion; b. centrifugal force; c. destructive force; d. temperature; e. noise, and these five factors are all interrelated. When energy is transmitted by a motor or a transmission shaft to a mill, torsion is produced first and then centrifugal force is generated from torsion. Centrifugal force is transmitted to a mill wheel to thus form the necessary destructive force for milling by virtue of mill wheel gravity. At the moment the destructive force is produced, the problems such as the increase in temperature and noise come to pass simultaneously. The interrelation among all these factors is not negligible. However, the prior mill design uses a motor running at a fixed speed whereby input torsion is fixed and, accordingly, the destructive force is also fixed. The Raymond Ring-Roller Mill in accordance with prior art is such a type, for example. A mill of such type has to change its motor for increasing torsion in case of inadequate destructive force, or in consideration of a need for increasing production capacity. Nevertheless, unreasonable use and random increases of motor horsepower often results in squeezing milled materials into flakes, while excessive destructive force is more liable to cause increased wear of the mill wheel or machine, the increase of noise, the rise of temperature and crystal repermutation of raw materials, which therefore causes a severe loss rather than an increase in productivity.

Though the devices in R.O.C. Patents 21011 (U.S. Pat. No. 3,955,766) and 24332 (U.S. Pat. No. 4,682,738) and 42355 have made some major improvements for grain milling (more than 13,000 meshes) and production capacity, they still fail to comply with GMP standards. Also, during the process of milling, the internal mill wheel will be pushed aside if it encounters a hard object. Upon overriding the obstacle, the internal mill wheel will soon hit the external mill which is the main cause for the mill wheels wearing.

In view of such problems as mill wheels wearing, unchangeable speed and failure of conform to GMP standard found in the prior arts and above-said mills, the inventor has devoted himself to delicate research together with related experience in machinery design and manufacture through persistent experiments and improvements, to successfully achieved the present invention.

SUMMARY OF THE INVENTION

One object of the present invention is to provide an upright lever pressure type mill which can conform to GMP standard.

Another object of the present invention is to provide an upright lever pressure type mill which may have multi-speed operation or even variable-speed operation in order to provide differnt destructive forces to meet the requirements of different raw materials.

Another object of the present invention is to provide an upright lever pressure type mill which can prevent mechanical wearing as a result of collision by means of the internal mill wheel tightly bearing against tightly the external mill wheel with preset pressure depending on spring tension or lever principle.

Another object of the present invention is to provide an upright lever pressure type mill which can obtain high destructive force at low running speed in order to increase production capacity and reduce noise.

Still another object of the present invention is to provide an upright lever pressure type mill which can increase separative effect and prevent the rise of temperature on raw materials by virtue of the design of a separation type separating chamber.

Still another object of the present invention is to provide an upright lever pressure type mill which can achieve a more steady milling effect by fixing the center of the external mill wheel by a centering bolt.

These and other objects and advantages of the present invention will become apparent to those skilled in the art after considering the following detailed specification together with the accompanying drawings provided by way of example only.

DETAILED DESCRIPTION OF THE PREFERRED EMBODIMENT

Figure 1:
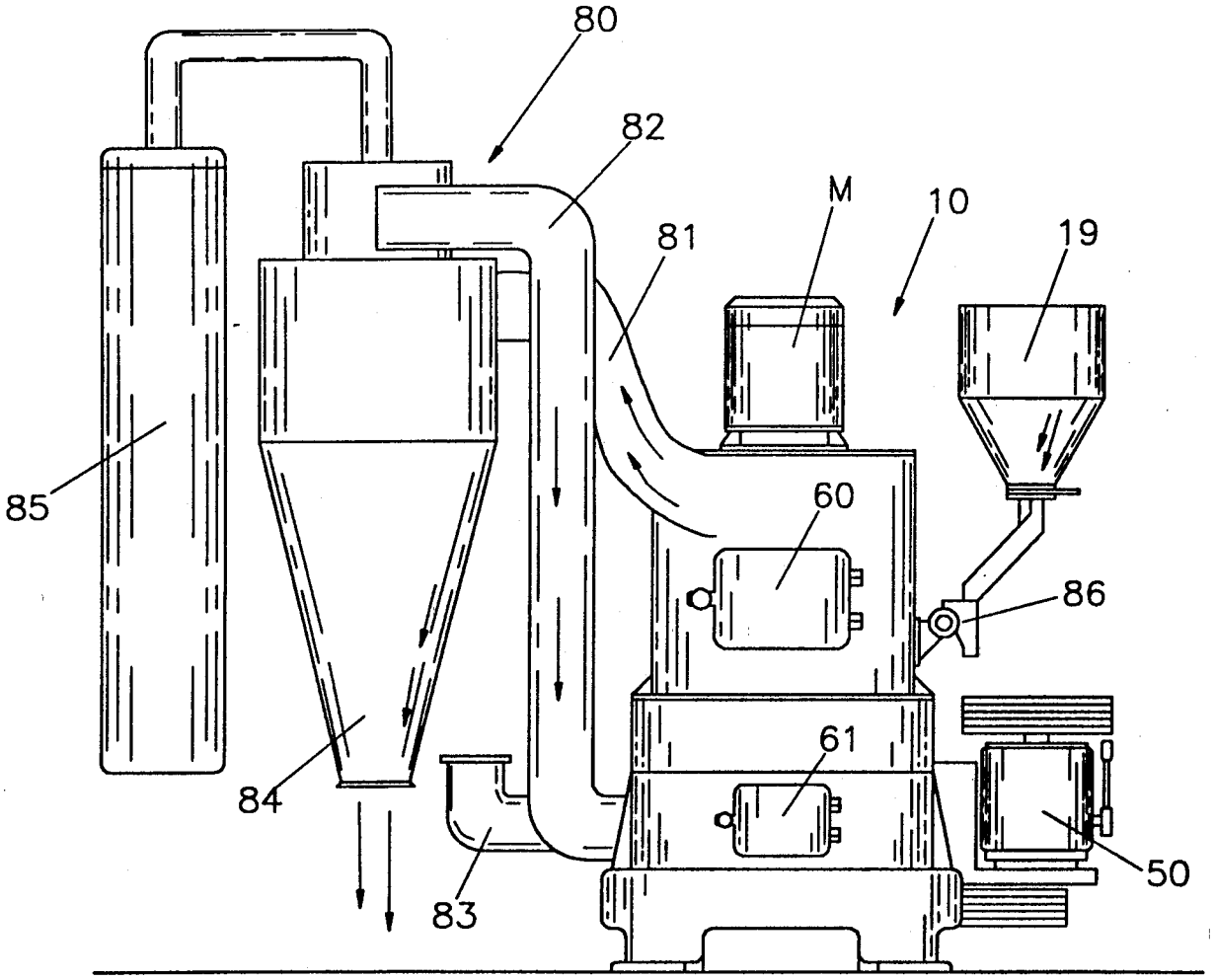
FIG. 1 is a schematic view of the mill of the present invention in connection with peripheral devices for its practical application.

Referring to the drawings, the upright lever pressure type mill 10 according to the present invention includes a fan motor M, main body, powder suction/delivery device, separator 30, milling device, variable speed transmission mechanism 50 and powder collector 80. The construction, function and principle of each member and device will be described together with accompanying drawings.

Figure 2:
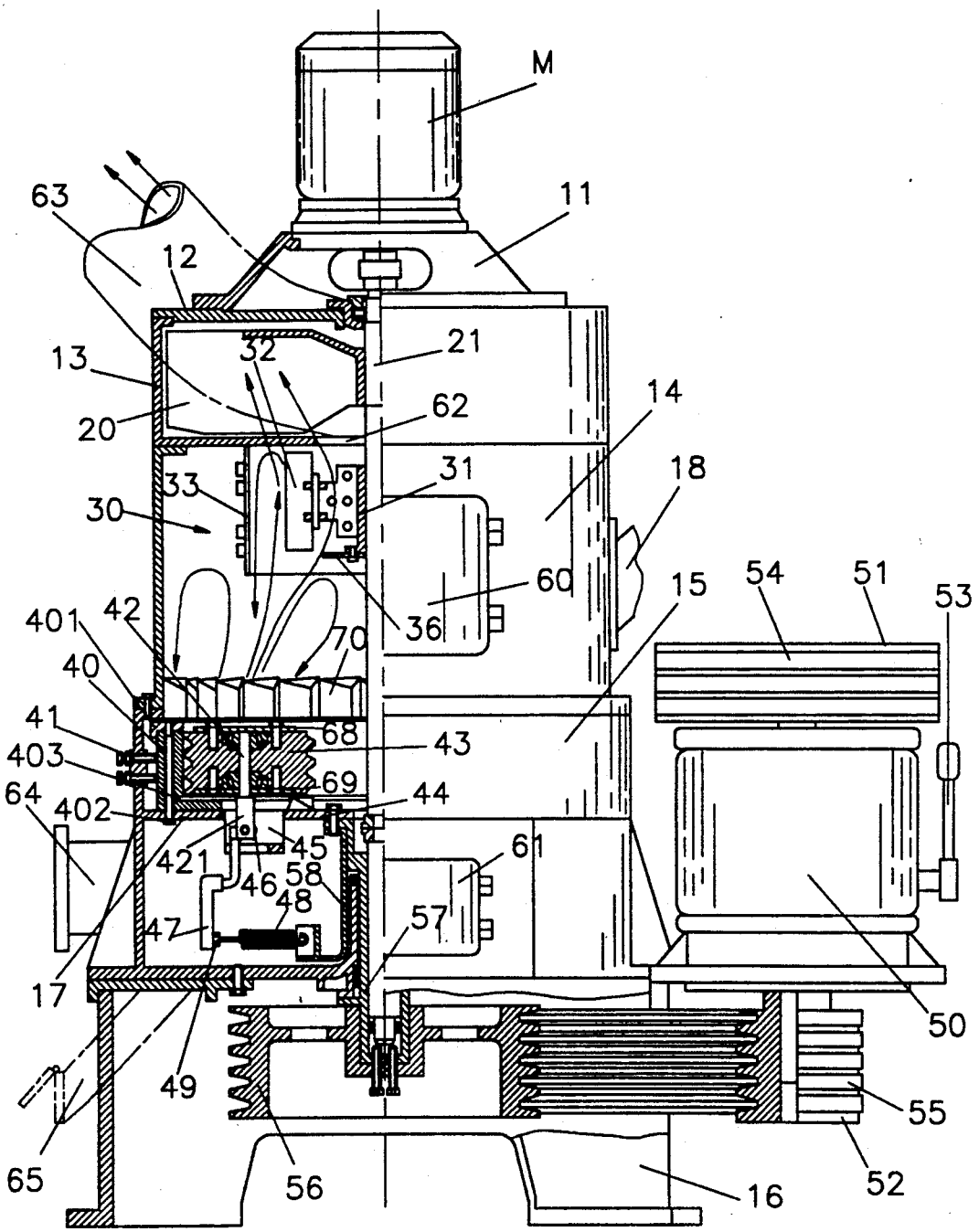
FIG. 2 is a front view partially in section, of the connection of each internal device according to the present invention.

Referring to FIG. 2, the main body of the mill 10 comprises an upper cover plate 12, upper body 13, intermediate body 14, lower body 15 and a base 16. The upper cover plate 12 secures a motor support 11 thereon for vertically supporting a fan motor M. The spindle of the fan motor m downwardly penetrates through the upper cover plate 12, the upper body 13 and in connection with the main shaft 21 of fan motor M. The main shaft 21 of the fan motor M includes an upper shaft and lower shaft connected together by virtue of a coupler. Fan blade 20 is fixed to the main shaft 21 of the fan in order to form a powder suction/delivery device within the upper body 13. The upper body 13 has a fan intake port 62 at the bottom portion and an exhaust port 63 sidewise in connection with a powder feed pipe 81.

Figure 4:
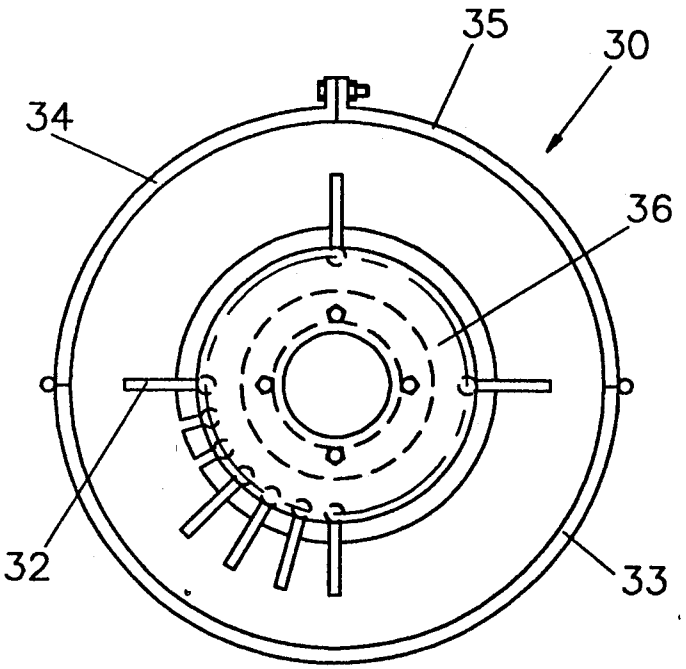
FIG. 4 is a bottom view of the separator according to the present invention.
Figure 3:
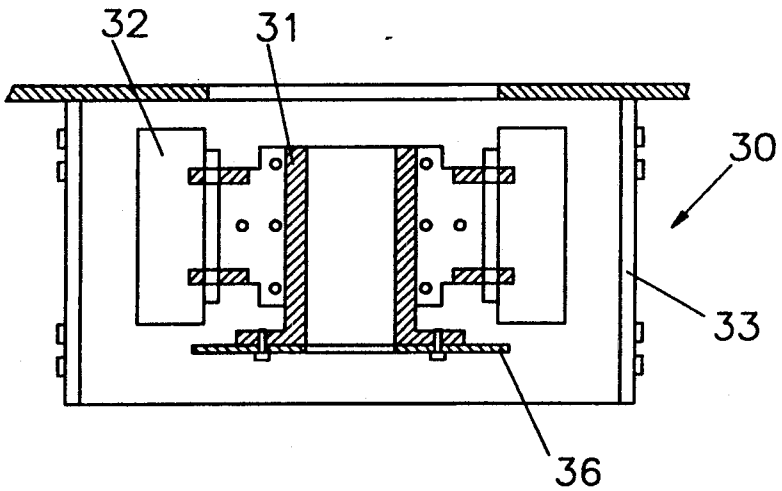
FIG. 3 is a cross sectional view of a separator according to the present invention.

The main shaft 21 of the fan extends further downwardly through the fan intake port 62 to enter the intermediate body 14 for mounting the separator 30, and still extends still further to reach the lower body 15. The upper and lower ends of the main shaft 21 have a number of thrust bearings and an intermediate portion has a number of roller bearings. Referring to FIGS. 3 and 4, the separator 30 includes a shaft sleeve 31, a number of separating blades 32, a fixed hood plate 33, two movable hood plates 34 and 35, and a damper 36. The fixed hood plate 33 is formed resembling a semi-cylindrical thin sheet and its upper edge is secured to the periphery of fan intake port 62, together with two movable hood plates 34 and 35 respectively resembling a quarter circle, in order to form a separating room for accommodating the separator 30. The shaft sleeve 31 has a hollow cylindrical shape and its upper and lower ends respectively form a rotary table 312 having a number of equally spaced installation holes 311. Each separating blade 32 has a rectangular shape and is set in each corresponding installation hole 311 on the rotary table 312 in a radial arrangement by virtue of a stop portion 321 mounted sidewise. The shaft sleeve 31 has a damper 36 at the bottom portion. As the separator 30 is accommodated in the separation type separating room, a necessary amount of air and space for agitation is smaller and, accordingly, the necessary horsepower for the fan motor M is smaller. Further owing to the separating function provided by the separating room, the high temperature produced from milling will not be brought into the separating room. Further because of a smaller structure driven by the motor M, noise is thus reduced.

Referring to the drawings, the milling device located in the lower body 15 includes an integrally-molded external mill wheel 40, a centrifugal disc 44, and a number of internal mill wheels 43 (total 3 sets for the embodiment) mounted on the centrifugal disc 44. Wherein the external mill wheel 40 is mounted at the flange 17 inside the first half portion of the lower body 15 and the location of its horizontal center is adjustable and fixed by virtue of four centering screw sets 41 mounted around the periphery of the external mill wheel 40. It is vertically adjustable by a number of bolts 402 penetrating from the bottom portion through the flange 17 and the wall of external mill wheel 40 for fastening together with a bushing 401 to lock the external mill wheel 40 securely in order to make milling more smooth. Wherein the four centering screw sets 41 each includes two screws and each centering screw 41 has a lock nut, when the external mill wheel 40 is placed on the flange 17 inside the lower body 15, the center can be obtained by virtue of a dial gage or other means to enable the center of external mill wheel 40 to coincide with the turning center of centrifugal disc 44. The coincidence of the two centers is adjusted by virtue of adjusting each centering screw set 41. When the center line is obtained, the locking nut on each centering screw set 41 should be screwed tight in order to prevent the screw from becoming loose and in order to assure that the external mill wheel 40 will not deflect. In addition, the external mill wheel 40 radially includes a groove 403 located at the contact between the vertical wall and the horizontal wall inside the external mill wheel 40. The groove 403 is provided as a basis for observing the extent of wear and the ultimate limit of wearing. Once the wearing extent has reached the bottom portion of the groove 403, it indicates that the useful life of external mill wheel 40 is up and the external mill wheel 40 must be replaced to avoid incidental fracture of external mill wheel 40 due to excessive use.

Figure 10:
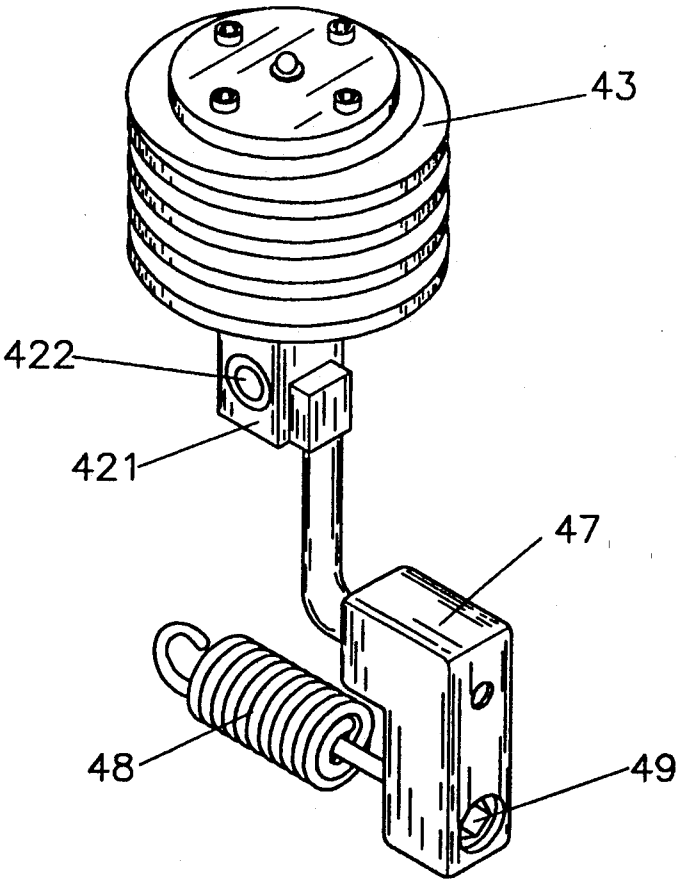
FIG. 10 is a perspective view showing the extension rod and the spring in the first embodiment of the present invention.
Figure 11:
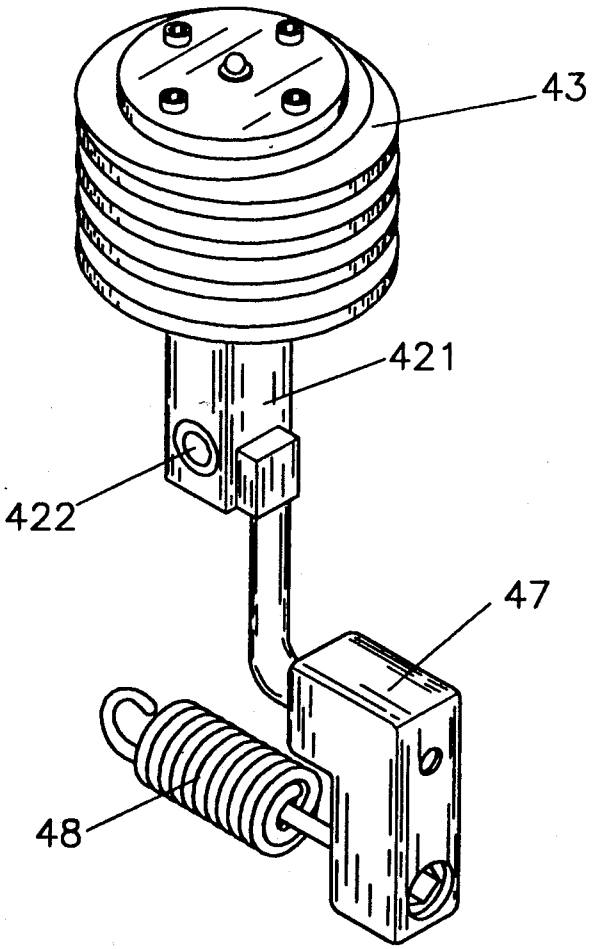
FIG. 11 is a perspective view showing the connection of the internal mill wheel, the extension rod and the spring in a second embodiment according to the present invention.
Figure 12:
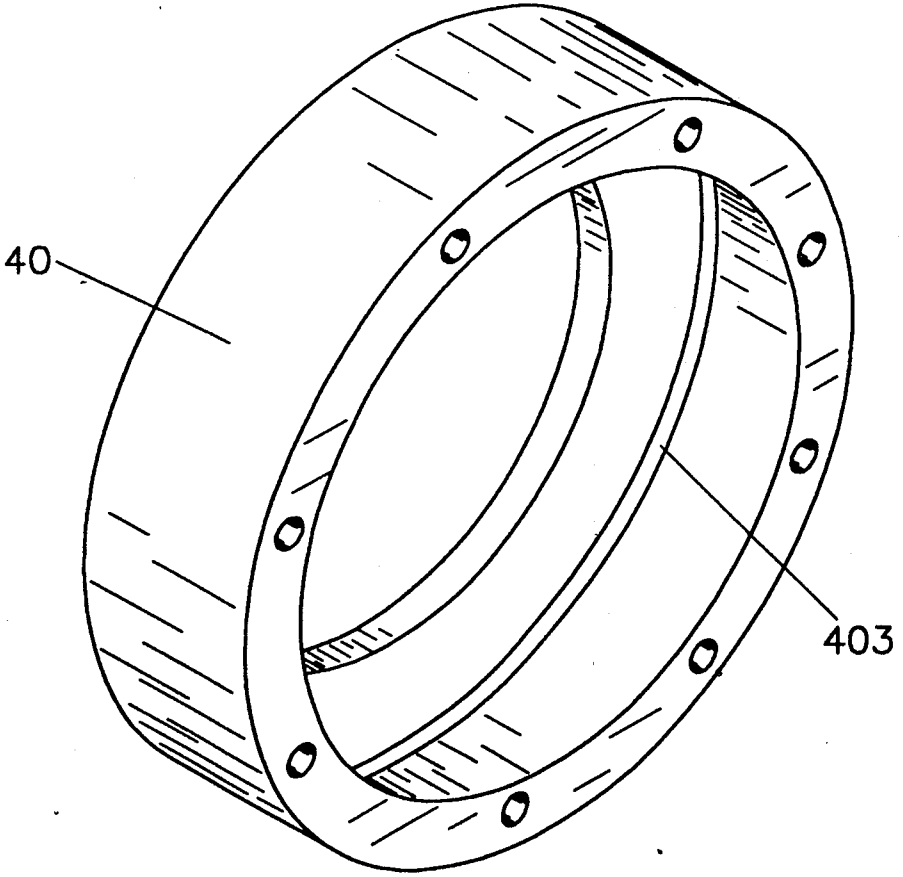
FIG. 12 is a perspective view showing the construction of an external mill wheel according to the present invention.
Figure 13:
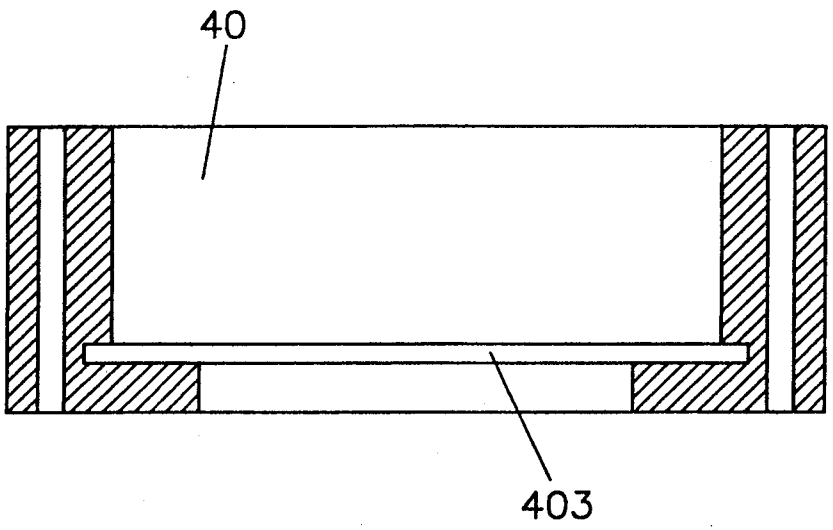
FIG. 13 is a cross-sectional view showing the construction of the external mill wheel including a groove.

The centrifugal disc 44 is securely mounted at the main shaft sleeve 58 (to be described in more detail). The periphery of the disc has corresponding pivot seats 45 arranged in equal distance to match the numbers of internal mill wheel 43 (total 3 for the embodiment). The section of each pivot seat 45 resembles a U-type column and each side wall has a hole 46. The outer end of bottom portion has a notch for accommodating the extension rod 47 of internal mill wheel spindle 42. The internal mill wheel spindle 42 has a stem shape with the upper end connected with the internal mill wheel 43 and the lower end connected with a pivot joint 421. The pivot joint 421 has a pivot hole 422 for pivoting in the hole 46 of pivot seat 45. A number of conical bearings are mounted between the internal mill wheel 43 and the spindle 42 in order to enable the internal mill wheel 43 to smoothly rotate. Also, the upper and lower ends of the internal mill wheel 43 have a dust-proof cover plate. Referring to FIG. 10, an extension rod 47 is mounted under each pivot joint 421 wherein the extension rod 47 may have an L-shaped portion and an inverted L-shaped portion wherein the vertical portion of the L-shaped body is connected to the lower end of pivot joint 421 and the horizontal portion of the inverted L-shaped body is connected to the horizontal portion of the L-shaped portion to enable the horizontal portion of both to extend outwardly in order to increase the distance from the vertical portion at the lower end of inverted L-shaped body to the main shaft sleeve 58. The end of the vertical portion of inverted L-shaped extension rod 47 has an adjusting bolt 49 and a tension spring 48 between the bolt 49 and the main shaft sleeve 58.

The tension spring 48 is for the purpose of enabling the internal mill wheel 43 to have a preset pressure by virtue of leverage in order to maintain the internal mill wheel 43 with appropriate pressure against the external mill wheel 40. As the fulcrum of internal mill wheel 43 is located at the hole 46, it is attributed to the lever of the second order—fulcrum in the middle portion. Therefore the magnification of lever is equivalent to the ratio of the length of extension rod 47 under the fulcrum and the length of internal mill wheel spindle 42 so that the extension rod 47 should be elongated as much as possible within a permissible range in order to obtain better efficiency. However, if excessive pressure were employed upon the internal mill wheel 43, the starting load will be increased, thereby requiring a higher horsepower in order to operate. Therefore, it must be properly selected. The position of fulcrum is thus designed subject to the requirement of the destructive force rather than on a fixed basis.

The variable speed and transmission device is another key point to the present invention. The design of the present invention adopts three major types of transmission: A. fixed motor speed and fixed destructive force for milling machine; B. fixed motor speed and a milling machine having a variable speed mechanism and a variable destructive pressure; C. VS (variable speed) motor and variable destructive pressure for the milling machine. Type A is a conventional way of power feed. However, due to the fixed destructive force, it is suitable to a limited range of raw materials; optimum production cannot be accomplished if a small change in any characteristics such as temperature, humidity and material, etc., not to mention of suitability to other kind of raw materials. In the past most manufacturers have made their design based on a blind use and have never considered the change in destructive pressure and therefore only such type of transmission has been applied in the past. Referring to type C, as it adopts VS motor, it can be flexible to set up optimum output horsepower from time to time subject to the condition of material, milling condition and variety of raw materials. However, it requires a higher level of operating skill, and higher maintenance and manufacturing costs. Type B could be popular with the users and therefore the present embodiment is centered around type B. Referring to FIGS. 1 and 2, after power is transmitted from the motor (not shown), the first drive belt wheel on the motor spindle will transmit it to the first driven belt wheel 51 on the input end of gear box 50 by virtue of a number of belts 54. The gear box 50 can be adjusted to the appropriate rotational speed through the gear changing lever 53. After the adjustment of rotational speed, power is transmitted from the second drive belt wheel 52 at the output end of gear box 50 to the second driven belt wheel 56 fixed on the main shaft 57. The main shaft 57 drives the centrifugal disc 44 and the main shaft sleeve 58 in rotation.

Referring to FIG. 2, the lower body 15 has an intake port 64 sidewise along the direction of a tangent line for connecting a recovery pipe 82. The bottom portion of lower body 15 has a residue discharge pipe 65 extending outwardly through the machine base 16. The intermediate body 14 and the lower body 15 have respective movable doors 60, 61 wherein the movable door 60 is located at the movable hood plates 34, 35 of the separator 30 for mounting/dismounting the blade 32 for cleanup as well as for the repair or maintenance of the separator 30 when the hood plates 34, 35 are open. In addition, the movable door 60 can be provided for visual check, maintenance and cleanup of the milling device. The small movable door 61 is mounted on the lower body 15 for setting the tensile force of tension spring 48 by adjusting bolt 49 and can also be provided for checking the relation of centrifugal disc 44 to the internal mill wheel spindle 42.

Figure 5:
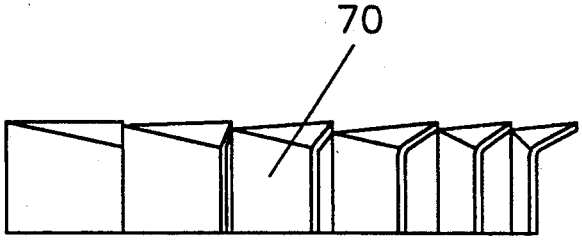
FIG. 5 is a partial side view showing a deflecting plate located at a bottom end inside the intermediate body according to the present invention.
Figure 6:
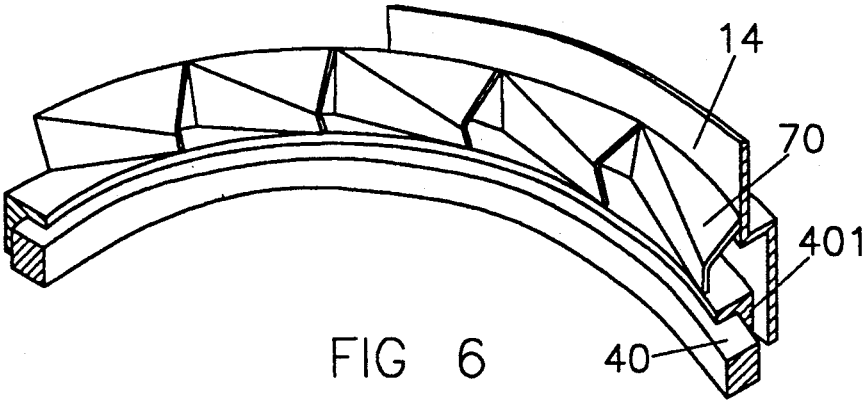
FIG. 6 is a partial, perspective view showing the construction of the deflecting plate according to the present invention.
Figure 9:
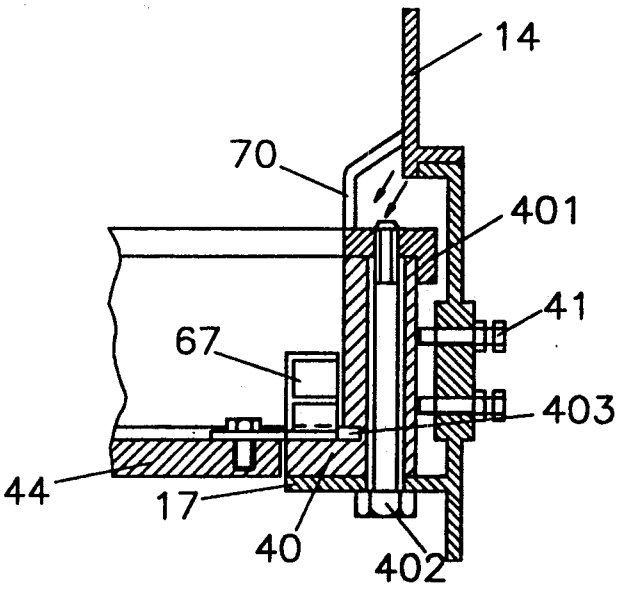
FIG. 9 is a partial cross-sectional view showing the construction of a plow plate mounted on a centrifugal disc according to the present invention.
Figure 7:
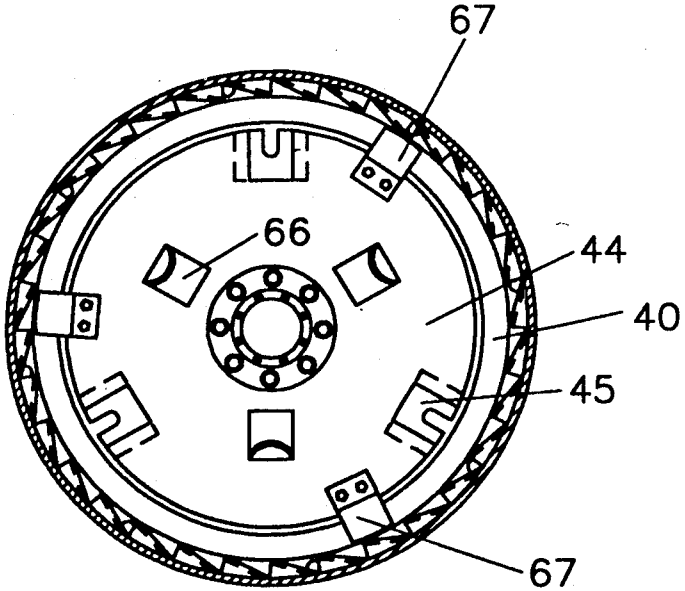
FIG. 7 is a top view showing the construction of the deflecting plate and its location in the mill according to the present invention.

Referring to FIGS. 5, 6, 7, a number of deflecting plates 70 are mounted between the lower body 15 and intermediate body 14 and around the top end of external mill wheel 40. The top portion of deflecting plates 70 has an oblique orientation to prevent accumulation of milling powder thereon. In addition, there are a number of air openings 66 facing outwardly and mounted at the top of centrifugal disc 44. A number of laminated and oblique plow plates 67 are mounted along the periphery of centrifugal disc 44 and project over the wall of external mill wheel 40. The plow plates 67 are provided for carrying milling powder to enable milling powder at upper and lower portions to be charged between the internal mill wheel 43 and external mill wheel 40 with a uniform distribution in order to obtain a homogeneous milling effect and to avoid piling up of raw material. The air openings 66 are provided for blowing the raw material loose in order to prevent raw material from curdling due to extrusion and failure of effective milling.

Referring to FIG. 1, the mill of the present invention in general is operated together with a dust collector 80 and charging mechanism wherein the charging mechanism includes a charger 86 directly connected to the charge port 18 on the mill 10 and a charge bucket 19 connected to the charger 86 wherein the charger 86 has two electric magnets (with strong magnetism) at the inlet in order to remove magnetic impurities such as iron dust and particles, etc. The powder collector 80 includes a powder delivery pipe 81 connected to the exhaust port 63 of upper body 13, a recovery pipe 82 and cooling pipe 83 connected to the recovery port 64 on the intermediate body 14, and a collection pipe 84 and a dust collection pocket 85. When powder is discharged from the milling machine 10 by virtue of powder suction/delivery device and the exhaust port 63, it will enter the powder collector 80 by powder delivery pipe 81. Powder of grain size conforming to the desired size will be delivered through the collection pipe 84 for sacking and other subsequent procedures. Powder of non-conforming grain size will be blown into the intermediate body 14 by the fan through the recovery pipe 82 for secondary milling. The dust collection pocket 85 for loading dropped powder will need regular cleanup and maintenance as described below.

As the present invention adopts preset pressure type grinding formed by virtue of the resilience of spring 48, raw material for grinding has to be changed in the external mill wheel 40 before starting the machine. The volume of charge is approximately at a 1/3 height of external mill wheel 40 in order to avoid wearing of the internal mill wheel 43 and the external mill wheel 40 as a result of idle friction. When the machine is started, the fan motor M starts running first and then the main motor. When the main motor starts running, power is transmitted from a first drive belt wheel in sequence to a first driven belt wheel 51, gear box 50, second drive belt wheel 52, second driven belt wheel 56 and then to the main shaft 57. When the main shaft 57 starts rotation, the centrifugal disc 44 and main shaft sleeve 58 fixed thereon are also rotated. At the moment the internal mill wheel 43 starts revolution around the main shaft 57 and main shaft sleeve 58 along the inner wall of external mill wheel 40 to produce a milling function, the internal mill wheel 43 will spin around the spindle 42 as a result of frictional force of the contact area. As the extension rod 47 at the bottom portion of the spindle 42 is held by the tension of spring 48, so the internal mill wheel 43 can be held tightly against the external mill wheel 40 in order to achieve high-efficiency milling, as well as to prevent them from wearing due to collisions between the internal mill wheel 43 and the external mill wheel 40. Therefore, the present invention not only minimizes noise produced, but also prolongs the life span of mill wheels.

When the motor starts running, air will be delivered into the mill 10 by recovery port 64 and drawn upwardly through the air passage at the external side of external mill wheel 40. Such function is accelerated by the eddy current formed by each deflecting plate 70. Raw material stored in the charge bucket 19 is charged at a speed controlled by the charger 86 directly into the external mill wheel 40 centrifugal disc 44 is not affected by rising eddy currents because of the large granular size of the raw material. Raw material is squeezed between the external mill wheel 40 and the internal mill wheel 43 for milling and crushing by the centrifugal force of the rotating centrifugal disc 44, the push force of external mill wheel 40 and with the help of plow plate 67 and air opening 66. As the specific weight of the milled powder is quite small, it will float up in company with the eddy current to enter the separation room formed by the fixed hood plate 33 and movable hood plates 34 and 35. Due to the centrifugal force, powder of large specific weight (i.e. large grains) is located at the outermost side of the eddy current and rises along the main shaft 21 until reaching the bottom portion of separator 30 to escape upwardly as a result of choking by the check plate 36. Due to the induced-draft function of the powder suction/delivery device, powder will be separated by the separator 30, sucked through fan intake port 62 and then discharged into the powder delivery pipe 81 by fan exhaust port 63.

Powder in the separator 30 is separated by the rotating blades 32 in order to crush or shoot a minority of the powder of large granular down into the milling device for secondary milling. Therefore, the greater the numbers of blades 32, the finer the granular powder. Impurities of large specific weight, which could hardly be crushed, or excessive raw material, will fall into the bottom of lower body 15 by virtue of deflecting plate 70 as a result of its own weight and centrifugal force and will be swept away through the residue discharge pipe 65 by a sweeping board on the external side of main shaft sleeve 58. With respect to power failure or turning off the power supply for the machine, due to the termination of fan suction and draft, raw material and milled powder will fall down as a result of their own weight. Some will fall into the bottom of lower body 15 and by virtue of deflecting plate 70, which will be swept away through the residue discharge pipe 65 by the sweeping board inertially driven by the main shaft sleeve 58; some powder will fall into the external mill wheel 40 and can be used as the necessary basic material for starting the system operation next time. Once the power supply is restored, the machine can be started again immediately.

The gear box 50 of the present invention has two different kinds of application: one is to have variable speeds such as high speed, medium speed, medium-low speed and low speed total four different speeds, and each running speed may provide different destructive forces subject to the requirements of different raw materials; the other application is to have an adjustable speed depending on requirements during the milling process, or to provide optimum pressure and running speed for a particular kind of raw material subject to the necessary destructive force for changes in such conditions as seasonal factor, temperature, humidity and viscosity in order to reach the highest production capacity. Raw material in general can be divided into three different groups according to its property: high fiber suitable for high speed, common fiber and condensed product suitable for medium speed; or mineral and viscose gelatin suitable for low speed. Therefore optimum milling can be accomplished through appropriate speed depending on the property of material.

For milling some special raw materials, such as herbs, medicine and chemicals, it is required to maintain a low temperature environment and to maintain humidity in some cases so that the present invention has a recovery pipe 82 connected to the recovery port 64 and may have a cooling pipe 83 connected to the recovery port 64 in order to guide in freezing and dry air for cooling or to feed in liquid nitrogen for overriding the difficulties of milling viscous substances. The volume of inflow gas can be controlled through a valve.

The above-mentioned embodiment is suitable for non-crystal substances. Because of the characteristics of crystal substances, the internal mill wheel 43 need not contact the external mill wheel 40 during the milling process. It is only required to squeeze its raw material with appropriate pressure to crush the material. The second embodiment as shown on FIG. 8 can be used to obtain better milling of crystal substances. The difference between the above-mentioned embodiment and the second embodiment will be described below.

Figure 8:
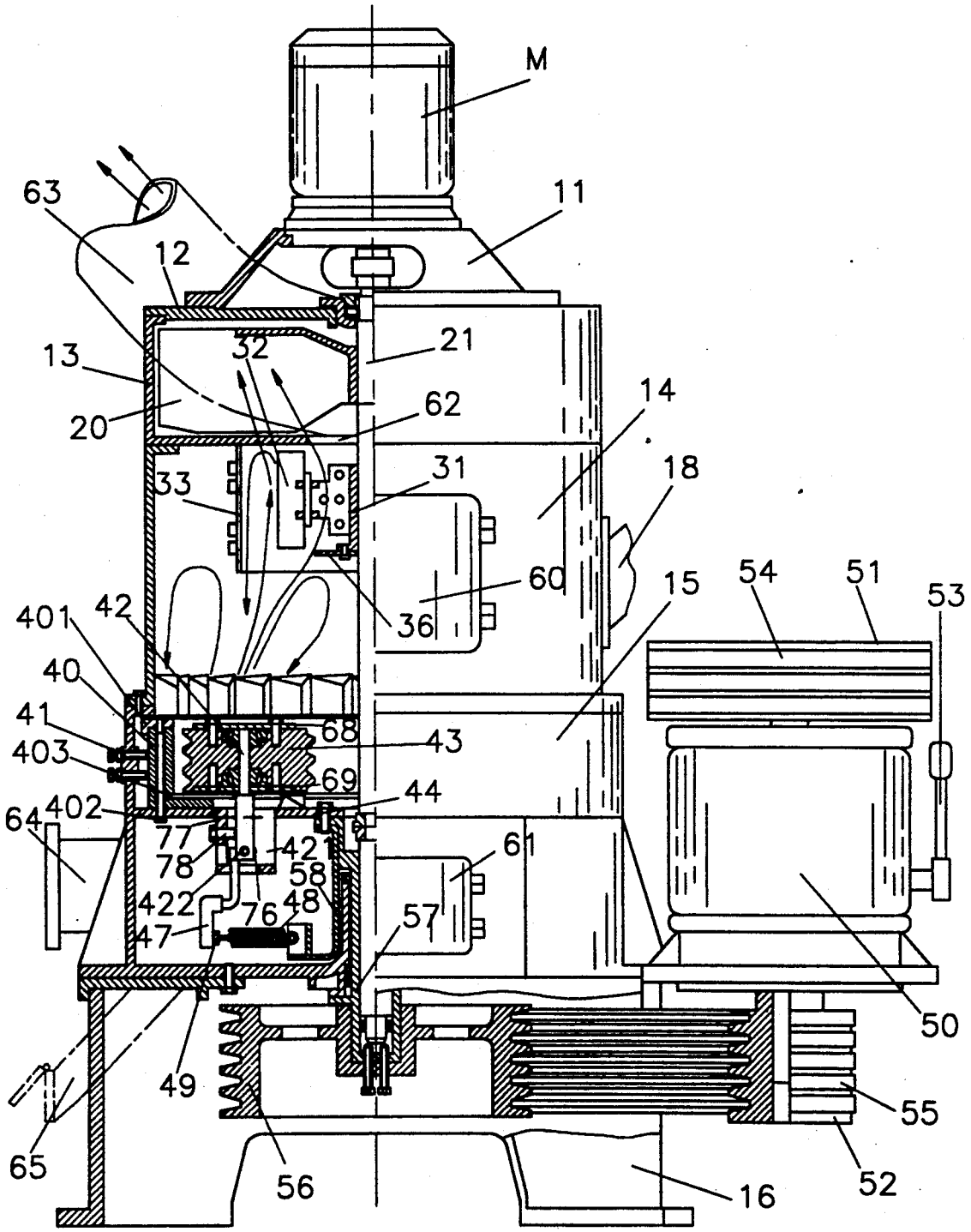
FIG. 8 is an a partial, cross-sectional view showing another embodiment of the mill according to the present invention.

Because the internal mill wheel 43 is not required to contact with the external mill wheel 40, this embodiment adopts a higher pivot seat 75 mounted on the centrifugal disc 44. Referring to FIG. 8, the hole 76 on the pivot seat 75 is located at a lower position than that in the first embodiment, and the pivot seat 75 also includes a check plate 77 at the external side with an adjusting screw 78 thereon for adjusting the distance between the internal mill wheel 43 and the external mill wheel 40 in order to assure that they do not to contact each other in order to achieve a higher milling efficiency for crystal substances such as sugar, salt, minerals, chemicals, medicine and viscous crystals (such as resin).

Many changes, modifications, variations and other uses and applications of the present invention will, however, become apparent to those skilled in the art after considering the foregoing specification together with the accompanying drawings. All such changes, modifications, variations and other uses and applications which do not depart from the spirit and the scope of the invention are deemed to be covered by the invention which is limited only by the claims which follow.

I claim:

1. An upright lever pressure type mill comprising:

a main body comprising a top plate, an upper body, an intermediate body, a lower body and a machine base;

a fan motor secured to the top plate of the main body the fan motor having a spindle;

a fan main shaft connected to the spindle of the fan motor with an upper shaft and a coupler and generally vertically extending downwardly into the main body;

a powder suction/delivery device secured to the fan main shaft and located in the upper body, the device including a plurality of blades radially arranged for discharging milled powder outside the main body;

a separator mounted at a top end of the intermediate body, including, the separator comprising:

a fixed hood plate having a top end secured to the upper body and located within the intermediate body;

two movable hood plates respectively pivoted to the fixed hood plate so as to define a separation room in conjunction with the fixed hood plate;

a shaft sleeve secured to the fan main shaft and located in the separation room;

a check plate secured to a bottom portion of a rotary table; and a plurality of separating blades detachably mounted on the shaft sleeve;

a power transmission device comprising:

a main motor;

a variable speed mechanism for converting a fixed speed input from the main motor into multiple output speeds, an input end of the variable speed mechanism and the main motor connected by a first speed reduction belt wheel; and a main shaft mounted at the machine base and extending upwardly into the lower body and connected to an output of the variable speed mechanism by a second speed reduction belt wheel;

a main shaft sleeve located on an outside of the main shaft and coupled to the main shaft for synchronous rotation therewith;

a milling device located in an upper half portion of the lower body, comprising:

an external mill wheel having a hole at the center;

a centrifugal disc secured to the main shaft sleeve and located in the center hole of the external mill wheel, its outer edge having a plurality of pivot seats;

an internal mill wheel spindle rotatably mounted in each pivot seat, having an upper end and a lower end to which is connected an extension rod; an internal mill wheel rotatably attached to the upper end of each spindle; and a plurality of tension springs having one end attached to the extension rod with an other end connected to the main shaft sleeve, and the number of tension springs corresponding to the number of internal mill wheels;

whereby, when power is transmitted from the main motor through the first speed reduction belt wheel, the variable speed mechanism and the second speed reduction belt wheel to rotate the main shaft, the main shaft sleeve, the centrifugal disc on the main shaft in order to drive each internal mill wheel for milling, the internal mill wheels are held tightly against the internal mill wheel by the force of the tension springs; the fan main shaft is rotated by the fan motor in order to operate the powder suction/delivery device and the separator in order to enable milled powder to float up with eddy current for discharging outside the main body after being separated by the separator.

2. The upright lever pressure type mill according to claim 1 wherein the intermediate body has an external wall defining a charge port and further comprising a movable door wherein the charge port may be externally connected to a charger and a charge bucket.

3. The upright lever pressure type mill according to claim 1 wherein the intermediate body comprises a plurality of deflecting plates located around a periphery of a bottom edge internally of the intermediate body, wherein each deflecting plate has a generally triangular shape and a top surface having an oblique portion.

4. The upright lever pressure type mill according to claim 1 wherein the upper body defines a fan intake port at a central bottom portion.

5. The upright lever pressure type mill according to claim 1 wherein the upper body further comprises a spiral powder delivery pipe extending upwardly.

6. The upright lever pressure type mill according to claim 1 wherein the centrifugal disc further comprising a plurality of plow plates to enable powder in two layers to enter between the internal mill wheels and external mill wheel for milling.

7. The upright lever pressure type mill according to claim 1 wherein the centrifugal disc defines a plurality of air openings for blowing milled powder loose in order to avoid caking.

8. The upright lever pressure type mill according to claim 1, wherein the lower body further comprises a residue discharge pipe for discharging excessive raw materials and impurities.

9. The upright lever pressure type mill according to claim 1, wherein the lower body has an internal flange and wherein the external mill wheel is mounted on the flange inside the lower body, and further comprising a plurality of centering bolts mounted around a periphery on the external mill wheel for adjusting and fixing the center of external mill wheel.

10. The upright lever pressure mill according to claim 1, wherein the external mill wheel has a vertical wall and a horizontal wall and further comprising an inwardly opening groove at the intersection of the vertical wall and horizontal wall to indicate the extent of wearing of the external mill wheel.

11. The upright lever pressure type mill according to claim 1, wherein the lower body defines a recovery port and comprising means to connect the recovery port with a recovery pipe and a cooling pipe.

12. The upright lever pressure type mill according to claim 1, further comprising means operatively associated with the pivot seat for adjusting the distance between each internal mill wheel and the external mill wheel in order to prevent each internal mill wheel from coming in contact with the external mill wheel in order to facilitate the milling of crystal materials.

* * * * *